US005658597A

United States Patent [19]

Breidenstein et al.

[11] Patent Number: 5,658,597

[45] Date of Patent: Aug. 19, 1997

[54] KIT FOR MAKING POSITIVE IMPRESSIONS OF TRACKS

[76] Inventors: Timothy J. Breidenstein, 4471 Hollister Ave., Santa Barbara, Calif. 93110; Jack Breidenstein, 2315 State St., Santa Barbara, Calif. 93105

[21] Appl. No.: 501,703

[22] Filed: Jul. 12, 1995

Related U.S. Application Data

[63] Continuation of Ser. No. 177,010, Jan. 3, 1994, abandoned.

[51] Int. Cl.[6] ..... B28B 1/14; B28B 7/02; B28B 7/06

[52] U.S. Cl. ..... 425/2; 249/155; 249/157; 249/187.1; 206/575

[58] Field of Search ..... 249/134, 155, 249/157, 187.1, DIG. 2; 425/2; 206/575

[56] References Cited

U.S. PATENT DOCUMENTS

| | | | |
|---|---|---|---|
| 993,914 | 5/1911 | Truman | 249/157 |
| 1,443,459 | 1/1923 | Carty | 249/157 |
| 2,854,724 | 10/1958 | Wauorio | 249/168 |
| 2,915,782 | 12/1959 | James | 249/168 |
| 3,004,283 | 10/1961 | Vanstrom | 249/157 |
| 3,109,361 | 11/1963 | Nicoli | 249/157 |
| 3,512,747 | 5/1970 | Stark | 249/DIG. 2 |
| 3,788,591 | 1/1974 | Arps | 249/1 |
| 4,439,071 | 3/1984 | Roper, Jr. | 248/48 |
| 4,479,629 | 10/1984 | Funnatsu | 249/157 |
| 4,828,116 | 5/1989 | Garcia | 206/575 |
| 4,830,543 | 5/1989 | Joubert | 249/13 |

FOREIGN PATENT DOCUMENTS

| | | | |
|---|---|---|---|
| 528553 | 6/1915 | Italy | 249/157 |
| 116998 | 7/1918 | United Kingdom | 249/157 |

*Primary Examiner*—Khanh P. Nguyen
*Attorney, Agent, or Firm*—Michael G. Petit

[57] ABSTRACT

A kit and a method for using the kit to form a positive impression of an animal track and the like. The kit is lightweight, preferably weighing less than two pounds, is compact and easily transported by a hiker. The kit includes a supply of impression material and an adjustable strip which is used to form a circular frame or margin around the track to contain the impression material. The kit also includes a container which may be of a cardboard type of material and a flexible, waterproof bag to contain the impression material. The bag, which contains between a half a pound and one and a half pounds of impression material, may be used to mix the impression material with water being added. Once a track is found, the adjustable strip including a band of biodegradable material with an impression material-releasing surface is placed around the track to contain the impression material. The impression material is mixed by slowly adding a sufficient amount of water to the bag and sealing the bag and kneading until it reaches the proper consistency. The impression material is then poured into the band to completely cover the track. Once the impression material hardens, the band may be removed and the impression material retains a positive impression of the animal track on its bottom surface. The size of the marginal band can be adjusted to standardize sizing and facilitate ease of handling and filling.

2 Claims, 1 Drawing Sheet

KIT FOR MAKING POSITIVE IMPRESSIONS OF TRACKS

Cross Reference to Related Applications

This is a continuation of application Ser. No. 08/177,010; filed Jan. 3, 1994 now abandoned.

BACKGROUND OF THE INVENTION

1. Field of the Invention

The present invention provides a kit and method for making a positive impression of a negative impression comprising a track.

2. Prior Art

Casting objects for future reference is well known. For example, if one wishes to form a positive impression of a body part one may first place the body part in a confining mold. A first impression material is injected into the mold around the body part so that the body part is completely surrounded. After the first impression material hardens, the mold is opened and, the body part removed. The mold may then be resealed and a second impression material injected therein which, when hard, will form a positive image of the body part being replicated. Such a kit and method for providing cast replicas of body parts is described in U.S. Pat. No. 4,828,116 to Garcia. The problem with the Garcia kit, is that for the production of a positive impression of an unconfined preexisting negative impression such as an animal track; the Garcia kit: a) does not have a marginal band for containing the impression material; and, b) teaches a method of making the positive image by first making a negative impression in a mold. Thus, the kit described by Garcia is not applicable to forming a positive impression of an unconfined negative impression comprising an animal track in, for example, sand or soil.

Casting tracks is well known in the forensic sciences. Police use such casting procedures to make a positive impression corresponding to negative impressions comprising tire tracks, foot prints and the like. The casting method used by forensic scientists comprises mixing plaster of Paris with water and pouring it into the track. Once the impression material hardens, it is pried up from the negative impression and stored as evidence. The "kit" for taking such impressions usually comprises a hundred pound sack of casting plaster in the trunk of a police car and a nearby hose or pail of water and a bucket and stick for mixing. While such materials and method may be applicable for persons having strong pack animals or those based in a vehicle, the transport of bulk materials for the purpose of casting animal tracks is not practical for hikers.

SUMMARY OF THE INVENTION

It is the object of this invention to provide a kit for casting tracks such as animal tracks which is light weight and compact.

It is yet another object of this invention to provide a kit for making an impression of a track which is easy to use in the field.

It is yet another object of this invention to provide a kit for making an impression of a track wherein the form of the hardened material bearing the impression of the animal track is circular and adjustable.

It is still further an object of this invention to provide a method for using a kit for obtaining a positive impression of a track.

These and other objects of the invention will be soon become apparent as we turn now to brief description of the drawings and a description of the preferred embodiment.

DESCRIPTION OF THE PREFERRED EMBODIMENT

Figure 1:
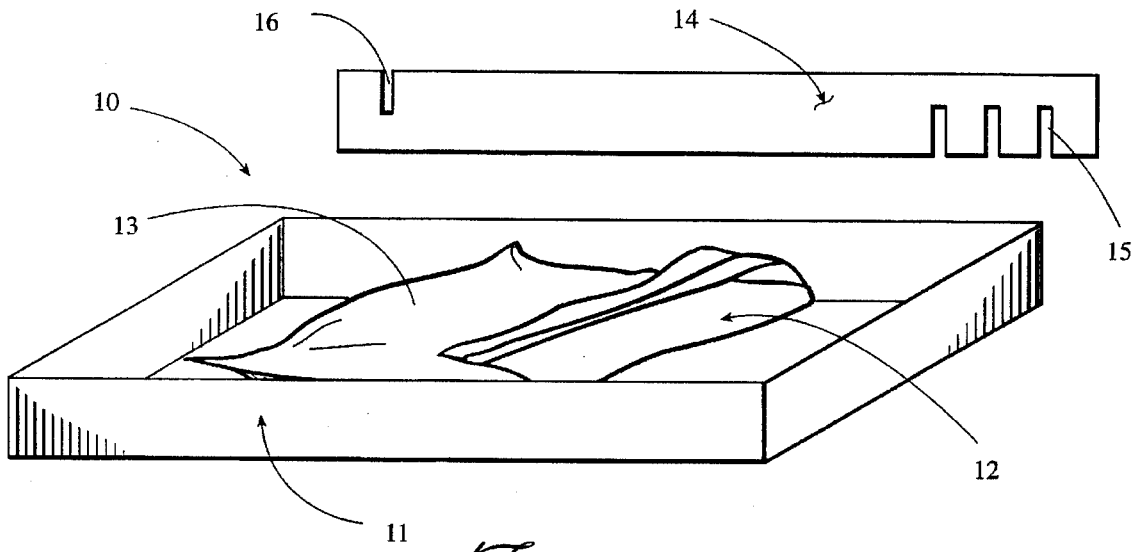
FIG. 1 is perspective view of the elements of the kit of the present invention.

For the purpose of teaching the preferred embodiment of the present invention, it is useful to consider casting a particular kind of track found in the field such as an animal track. The choice of an animal track is exemplary and not intended to be limiting. Referring now to FIG. 1 of the drawings, a preferred embodiment of the kit of the present invention is shown. The kit, generally indicated at the numeral 10, comprises a container portion 11, a mixing bag 12 with an impression material 13 enclosed therewithin. A band or strip 14 having unitary construction as shown in FIG. 1, and formable into a circle of variable diameter is included to provide a substantially circular marginal dam around the animal track to be cast. The mixing bag 12 is of a flexible, preferably biodegradable material and may conveniently be a Zip-Lot® bag or it may be a purse-string bag or it may be a bag with a twist like closure. In any event, the bag must be waterproof and capable of being kneaded; that is, be supple and deformable, and be dimensioned to provide a sufficient volume therewithin to accommodate an appropriate amount of dehydrated impression material and the volume of water required to convert the dried impression material into a material having a suitable consistency for pouring. The dehydrated impression material 13 may conveniently be a casting plaster such as is commercially available from Newton Building Materials in Goleta, Calif. The water is preferably obtained from a nearby natural source or a water bottle.

The flexible strip 14 is used to encircle and form a dam or barrier around the animal track for which an impression is desired. The strip 14 is preferably of a biodegradable material such as cardboard and has an inner surface which is treated to release the hardened impression material 21. The band 14 is positioned around the track and the appropriate pair of notches 15 and 16 are aligned and pushed together to enclose and encircle the track with approximately a one-to-two inch margin around the track. The strip may be plastic or any semi-rigid material such as a cardboard which can be pushed down into the material bearing the animal track to better retain the impression material when its poured there within.

Figure 2A:
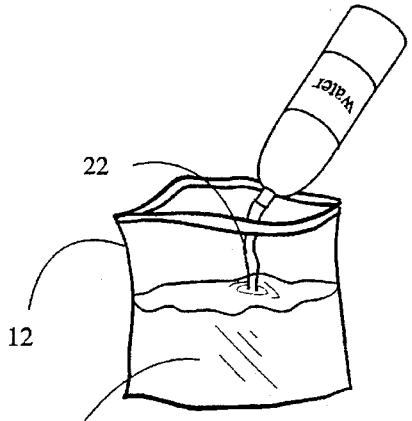
FIG. 2, *a, b, c, d* show the procedure used for making a positive image of an animal track.
Figure 2B:
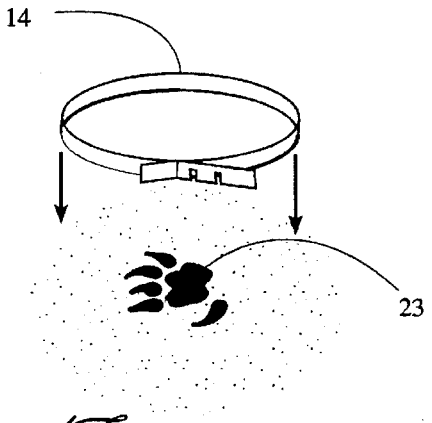
Figure 2C:
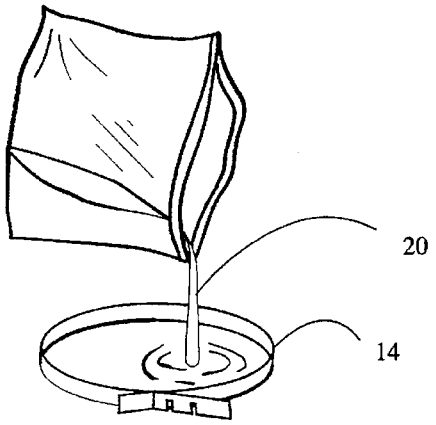
Figure 2D:
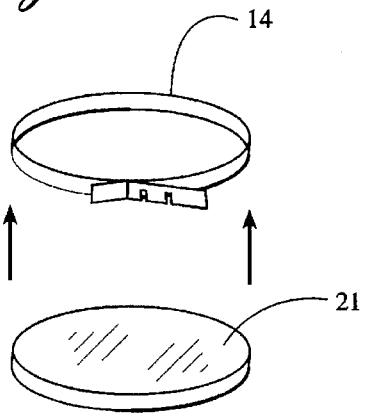

Turning now to FIG. 2, we see in FIG. 2*a* water 22 being added to the impression material 13 in sufficient quantity to convert the dried impression material to pourable consistency. FIG. 2*b* shows band 14 formed into a circle of the desired diameter and placed over the track 23. FIG. 2*c* shows the mixed and kneaded impression material 20 being poured into the encircling band 14 to completely cover the track 23. FIG. 2*d* shows the band ring 14 being removed as preliminary to removing the solidified impression material 21 beating the positive impression of the animal track. Alternatively, the band 14 may be left in its encircling position around the hardened impression-beating material 21 and removed later.

Preferably, the kit includes directions which indicate the mount of water required to mix the impression material contained therewithin to a proper consistency for pouring. A small mount of water is added to the impression material and the bag is closed and kneaded. This process is continued until the correct mount of water has been added and the impression material 20 is the consistency of thick pancake batter.

After preparing the impression material for pouring, the band 14 is connected to form a circle of the desired size to circumscribe the track by intersecting the upper slot 16 into one of the lower slots 15 and placed around the track. The impression material 20 is squeezed and extruded out of the bag slowly onto the track encircled by the ting. The drying time will vary with temperature and moisture. The average time is twenty minutes. The ring 14 is then removed from the casting 21.

Such a casting can be hung on a wall by adding a simple device such as paper clip or beverage can tab to the top of the casting material after it is poured, but before it hardens. It is also convenient to use a soft brush and water to clean the track after the casting material has hardened.

The flexible band is preferably of a biodegradable material and one to two inches in width, and between twenty inches and fifty inches in length, and approximately five to thirty mils thick. The band is slotted at both ends half way through on opposite sides to link together a closed form. The band may also be formed into a square, diamond, or any other desired shape to enclose the track being casted. The container 11, which may be employed to house the other components of the kit, is preferably of a biodegradable material such as cardboard.

While particular embodiments of the present invention have been illustrated and described it would be obvious to those skilled in the art that various other changes and modifications can be made without departing from the spirit and scope of the invention. The band, for example, may have adhesive means thereon to permit the band to be formed into a circle having a preferred diameter. It is therefore intended to cover in the appended claims all such changes and modifications that are within the scope of this invention.

What we claim is:

1. A kit operable for making a positive impression of a track wherein the track consists of a depression in a deformable surface and wherein the track may be contained within a circle having a preferred diameter; said kit comprising: a) a flexible collapsible container; b) an impression material contained within said collapsible container; and c) a flexible band having unitary construction and being deformable into a circle and including means for adjusting the diameter of said circle, said band having first and second ends having means thereon for locking said band into a circle having a preferred diameter; said means for locking said band comprising a first slot in said first end of said flexible band, said first slot being perpendicular to the length of said flexible band, and a plurality of slots in said second end of said flexible band, said slot in said first end being adapted to engage one of said plurality of slots in said second end of said band to lock said band in a circle.

2. The kit of claim 1 wherein said band is an elongate, flexible strip having a length and a width, and wherein said locking means comprises a plurality of slots extending partially through the strip in a plane parallel to the width and transecting the strip at right angles to the direction of the length.

* * * * *